US006573869B2

(12) United States Patent
Moore

(10) Patent No.: US 6,573,869 B2
(45) Date of Patent: Jun. 3, 2003

(54) MULTIBAND PIFA ANTENNA FOR PORTABLE DEVICES

(75) Inventor: Thomas G. Moore, Mount Prospect, IL (US)

(73) Assignee: Amphenol - T&M Antennas, Vernon Hills, IL (US)

( * ) Notice: Subject to any disclaimer, the term of this patent is extended or adjusted under 35 U.S.C. 154(b) by 0 days.

(21) Appl. No.: 09/814,171

(22) Filed: Mar. 21, 2001

(65) Prior Publication Data

US 2002/0135521 A1 Sep. 26, 2002

(51) Int. Cl.[7] ..... H01Q 1/24; H01Q 1/38
(52) U.S. Cl. ..... 343/702; 343/700 MS
(58) Field of Search ..... 343/700 MS, 846, 343/702, 767; H01Q 1/38, 1/24

(56) References Cited

U.S. PATENT DOCUMENTS

| | | | | |
|---|---|---|---|---|
| 5,926,139 A | * | 7/1999 | Korisch | 343/702 |
| 6,140,966 A | * | 10/2000 | Pankinaho | 343/700 MS |
| 6,195,048 B1 | * | 2/2001 | Chiba et al. | 343/700 MS |
| 6,229,487 B1 | * | 5/2001 | Sadler et al. | 343/700 MS |
| 6,252,552 B1 | * | 6/2001 | Tarvas et al. | 343/700 MS |
| 6,252,554 B1 | * | 6/2001 | Isohatala et al. | 343/700 MS |
| 6,366,243 B1 | * | 4/2002 | Isohatala et al. | 343/700 MS |

OTHER PUBLICATIONS

Jong–WonYu and Noh–Hoon Myung, "*Scattering by a Dielectric–Loaded Nonplanar Slit–TM Case*", IEEE Transactions On Antennas and Propagation, vol. 46, No. 4, Apr., 1998.

Jong–WonYu and Noh–Hoon Myung, "*Scattering by a Dielectric–Loaded Nonplanar Slit–TM Case*", IEEE Transactions On Antennas and Propagation, vol. 46, No. 4, Apr., 1998.

Suvi Tarvas and Anne Isohätälä, "*An Internal Dual–Band Mobile Phone Antenna*".

C.T.P. Song, P.S. Hall, H. Ghafouri–Shiraz and D. Wake, "*Triple band planar inverted F antennas for handheld devices*", Electronics Letters, vol. 36 No. 2, Jan. 20th, 2000.

Rainer Wansch, Harald Humpfer and Jürgen Hupp, "*An integrated F–antenna for diversity reception in a DECT data transmission module*", DECT: Digital Enhanced Cordless Telecommunication.

Zi Dong Liu, Peter S. Hall and David Wake, "*Dual–Frequency Planar Inverted–F Antenna*", IEEE Transactions On Antennas and Propagation, vol. 45, No. 10, Oct., 1997.

Corbett R. Rowell and R. D. Murch, "*A Compact PIFA Suitable for Dual–Frequency 900/1800–MHz Operation*", IEEE Transactions on Antennas and Propagation, vol. 46, No. 4, Apr., 1998.

* cited by examiner

*Primary Examiner*—Hoanganh Le
(74) *Attorney, Agent, or Firm*—Greer, Burns & Crain, Ltd.

(57) ABSTRACT

A multiband PIFA (planar inverted-F) antenna. A preferred embodiment makes use of a spiral slot. The spiral slot is formed to cause multiple frequency dependent nulls in the antenna's electric field modal distribution. The preferred embodiment antenna has a single element patch radiator formed on a dielectric support in an inverted-F relationship with a first ground plane. The dielectric support may be part of a device housing or internal board, e.g., a PCB board. The patch radiator includes a spiral slot. A feed is made to the single element patch radiator in a location relative to the spiral slot to ensure that portions of the single element patch radiator enclosed by the spiral slot are fed as a series extension of another portion of said patch radiator. According to a preferred embodiment, the patch radiator may be formed from a single conductive sheet, plating or deposit along with the shorting post and feed. A majority of its surface area is formed in a primary plane and its remaining surfaces define, generally perpendicular from the primary plane, a feed extending from a first edge of the primary plane and a shorting post extending from a second edge of the primary plane. A tab may be formed to add radiator surface area and may extend, for example, perpendicular from a third edge of the primary plane.

14 Claims, 4 Drawing Sheets

MULTIBAND PIFA ANTENNA FOR PORTABLE DEVICES

FIELD OF THE INVENTION

The field of the invention is antennas. The invention is directed to a compact multiband antenna for portable devices.

BACKGROUND OF THE INVENTION

Portable devices that communicate with wireless services frequently must operate in different frequency bands. Different frequency bands may be used, for example, in different geographical regions, for different wireless providers, and for different wireless services. Pagers, data terminals, mobile phones, other wireless devices and combined function wireless devices therefore often require an antenna or multiple antennas responsive to multiple frequency bands. As an example of the need for multi-band reception and transmission, high end "world" mobile phones need to accommodate at least three bands to account for two European (GSM/DCS) and one United States (PCS) band. A fourth band might even be required to account for additional services. A single antenna is desirable for obvious reasons of size and appearance, critical issues in wireless devices.

Although there are several designs available for external multi-band antennas, the trend in portable communication devices is to house the antennas internally or within or on the external device housing. Existing production internal antennas are either single- or dual-band designs.

SUMMARY OF THE INVENTION

A multibanded PIFA (planar inverted-F) antenna of the invention provides multiple operating bands in a suitable compact configuration for portable communication devices. A preferred embodiment makes use of a spiral slot. The spiral slot is formed to cause multiple frequency dependent nulls in the antenna's electric field modal distribution. The preferred embodiment antenna has a single element patch radiator formed on a dielectric support in an inverted-F relationship with a first ground plane. The dielectric support may be part of a device housing or internal board, e.g., a PCB board. The patch radiator includes a spiral slot. A feed is made to the patch radiator in a location relative to the spiral slot to ensure that portions of the single element patch radiator enclosed by the spiral slot are fed as a series extension of another portion of said patch radiator. According to a preferred embodiment, the patch radiator may be formed from a single conductive sheet, plating or deposit along with the shorting post and feed. A majority of its surface area is formed in a primary plane and its remaining surfaces define, generally perpendicular from the primary plane, a feed extending from a first edge of the primary plane and a shorting post extending from a second edge of the primary plane. A tab may be formed to add radiator surface area and may extend, for example, perpendicular from a third edge of the primary plane.

A single spiral slot will cause the antenna to have two primary resonances. Adding an additional spiral will double the number of resonances. An alternate way of increasing the number of resonant modes is to add a second ground plane electrically opposing only a portion of the single element patch radiator including the feed. The shorting post is from the antenna to the first ground plane and the first and second ground planes are connected together at some point. The effect of additional ground plane is to double the number of resonant modes of the antenna. These modes can be tuned by adjusting the location of the feed and spiral slot. The second ground plane can also be used to create additional bands in the absence of the spiral slot.

DETAILED DESCRIPTION OF THE PREFERRED EMBODIMENTS

The present invention provides a device designer the ability to have a multi-band, including tri- and quad-band designs, that is internal to the product or its external housing and occupies a reasonable amount of volume. The antenna does not require expensive materials and is therefore a cost-effective solution.

Figure 1:
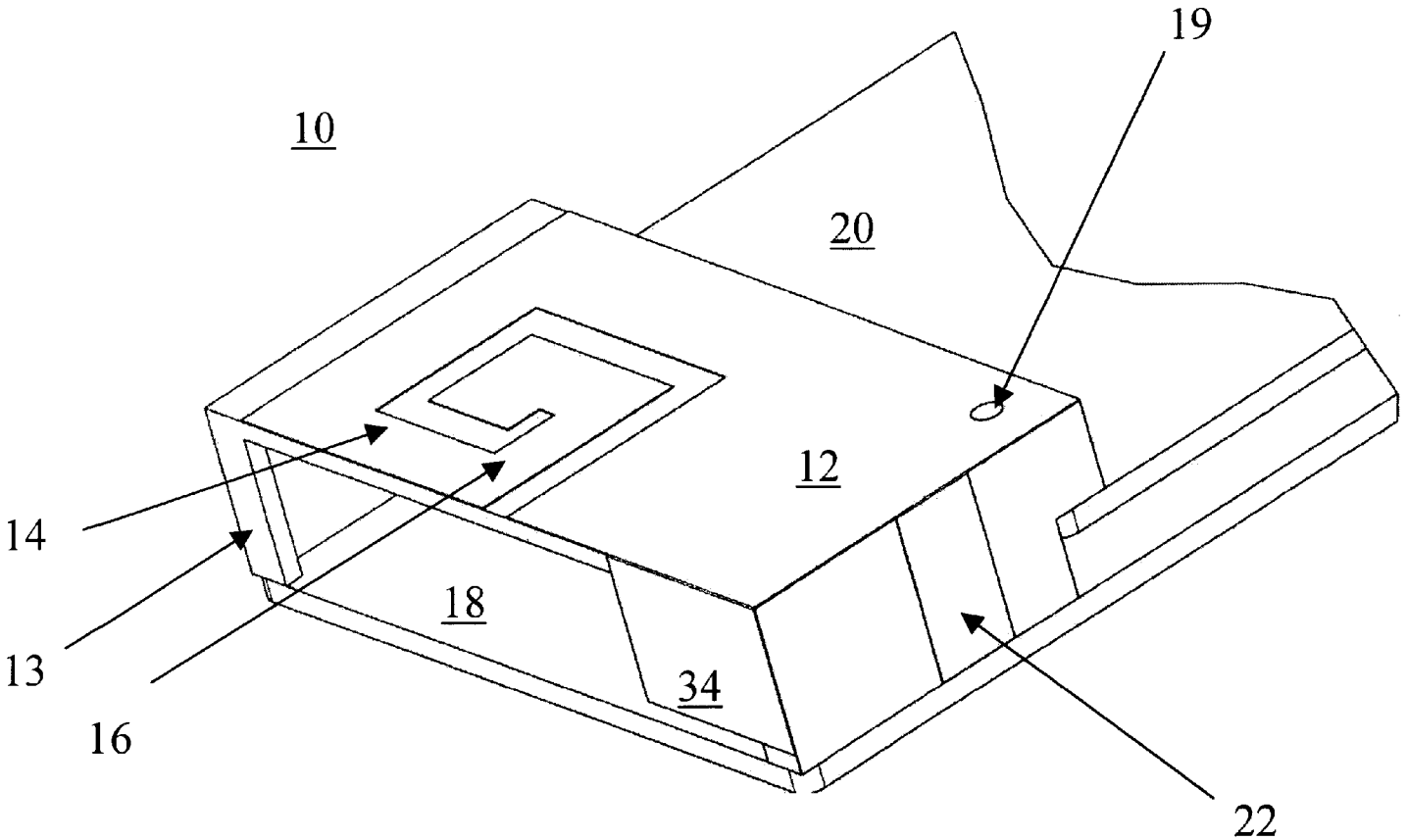
FIG. 1 is a partial perspective view of a preferred four band dual ground plane embodiment of the invention.

Referring now to FIG. 1, a preferred PIFA antenna 10 of the invention is generally arranged to include a single element patch radiator 12 formed around dielectric material 13, which may be part of a portable device, such as a housing or PCB board. The single element patch radiator 12 includes a spiral slot 14. The spiral slot 14 is formed in the single element patch radiator 12 to create nulls in the modal distribution at the antenna's high frequencies and a single but larger null at the antenna's low frequencies. An opening 16 in the slot faces away from a feed point 19. In this way, the entire patch radiator 12 is fed in series as a single radiator element. The feed is made in a location relative to the spiral slot 14 to ensure that portions of the single element patch radiator enclosed by the spiral slot are fed as a series extension of another portion of said patch radiator.

A first ground plane 18 is electrically opposite the entirety of the single element patch radiator 12. A second ground plane 20 is electrically opposite only a preferably small portion of the patch raditor 12, including a portion encompassing the feed point 19. The second ground plane 20 increases the number of resonant modes of the antenna 10. Without the second ground plane 20, the antenna 10 will resonate in two bands, and the second ground plane 20 increases the resonance bands to four. An alternate way to increase the number of bands is to add an additional spiral slot. Without a second ground plane or a second spiral slot, there are two primary resonances. Addition of either increases the number of primary resonances. Thus, the second ground plane adds resonances in the absence of a spiral slot as well. This forms an additional embodiment of the invention, i.e., a PIFA like that in FIG. 1 with the second ground plane 20 but lacking the spiral slot 14.

A shorting post portion 22 shorts an end of the single element patch radiator 12 to the first ground plane 18. The first ground plane 18 and second ground plane 20 are connected together at a point away from the shorting post 22 and the feed point 19.

Frequencies of the antenna 10 are set by factors including the spiral slot 14 and its relationship to the feed point 19.

Moving the center of the spiral slot 14 toward the feed point 19 tends to increase frequency of the antenna's high band resonance, and moving it away from the feed point 19 tends to decrease frequency of the antenna's low band resonance. Low frequency resonance is controlled by the size of the open loop 14, the size of the single element patch radiator 12, and the distance between the radiator 12 and the ground planes 18 and 20. The actual position of the spiral slot is generally arbitrary, excepting the requirement that its relative position to the feed point 19 should not be such to divide the single element patch radiator 12 into effective separate parallel radiators.

Figure 2:
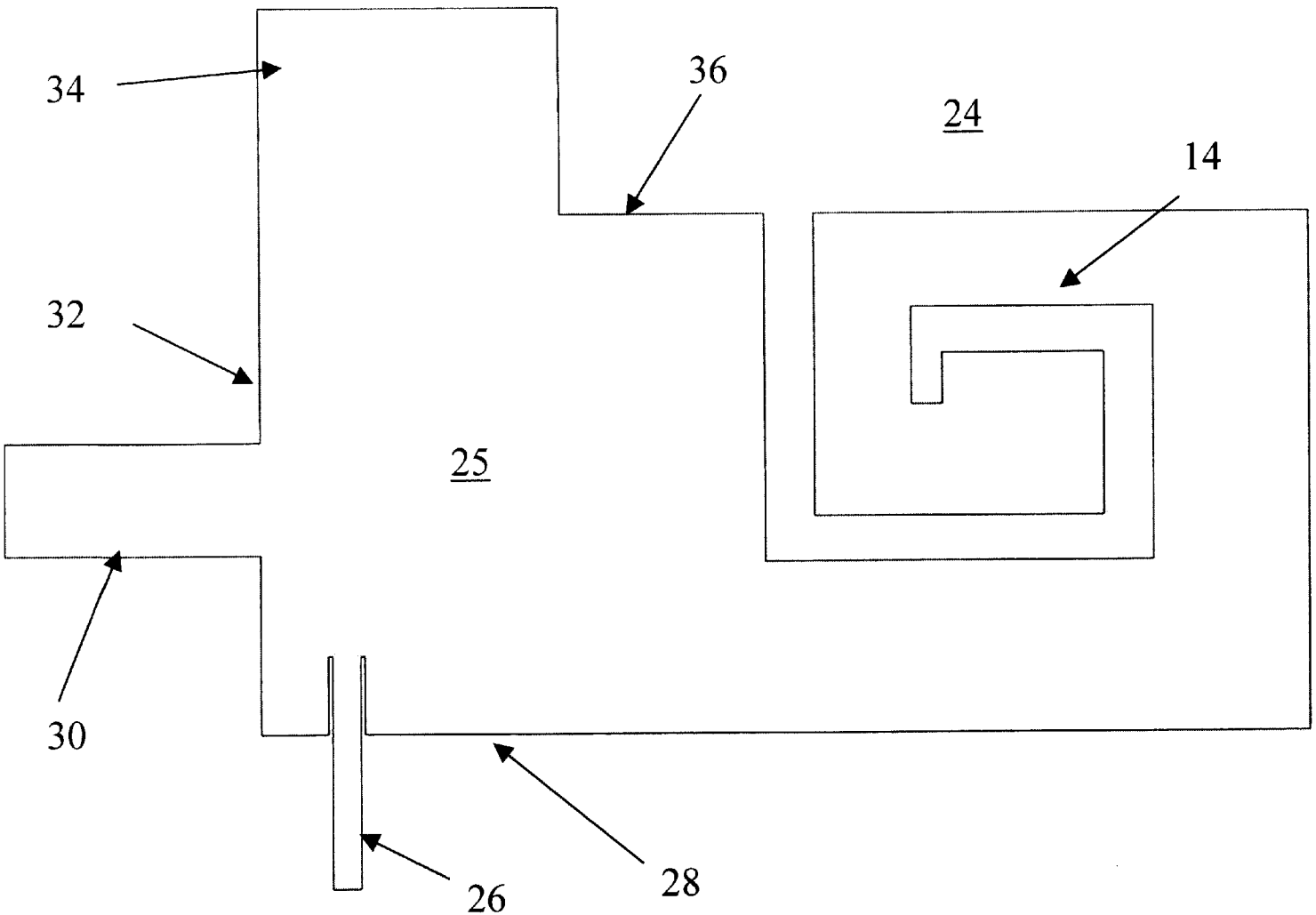
FIG. 2 is a perspective view of preferred embodiment conductive sheet usable to form radiator, shorting post, feed and conductive tab portions for a preferred embodiment antenna.
Figure 3:
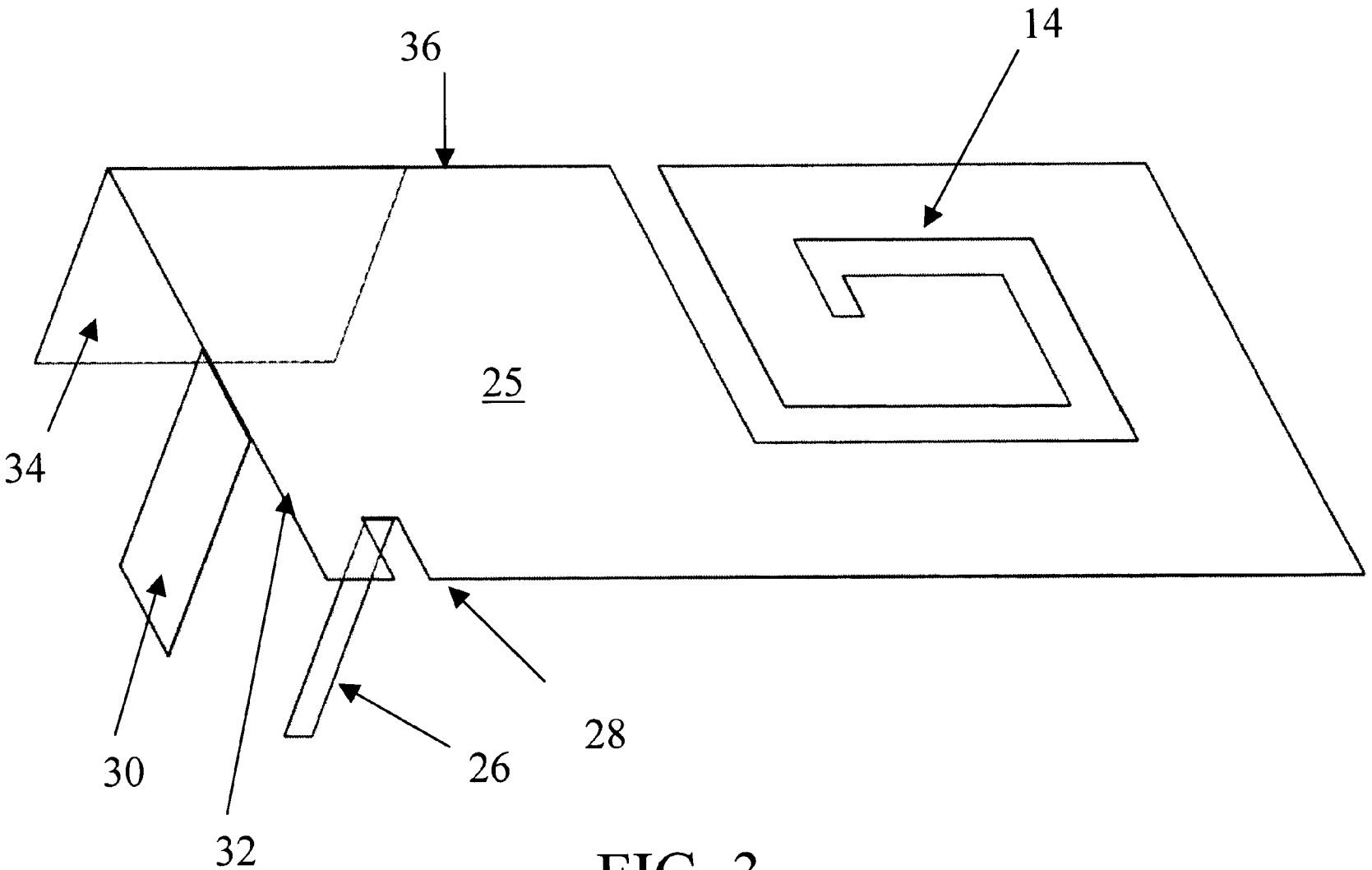
FIG. 3 shows the FIG. 2 conductive sheet shaped into a preferred form.

Referring now to FIG. 2, according to an embodiment of the invention, most of an antenna like the embodiment shown in FIG. 1 may be formed from a single sheet of conductive material 24 to be pressed into shape around a suitable dielectric support. The dielectric support may be part of a device housing or internal board, e.g., a PCB board. Artisans will appreciate that the antenna 10 might also be formed by a metal deposit, printing or plating over such a dielectric support. The shaped sheet of conductive material 24 be bent bent over a support, e.g., bent into the form of FIG. 3. A majority of its surface area is formed in a primary plane 25 and its remaining surfaces define, generally perpendicular from the primary plane, a feed 26 extending from a first edge 28 of the primary plane 25, a shorting post 30 extending from a second edge 32 of the primary plane 25, and a tab 34 extending from a third edge 36 of the primary plane 25. In FIGS. 2 and 3, the feed 26 is a portion of the sheet of conductive material 24 bent down from the first edge 28 of the sheet. The shorting post 30 is a portion bent down from a second edge 32 of the sheet 24. The tab 34 is bent down from the third edge 36 of the sheet. The tab 34 is ungrounded and serves to add additional surface area to the single element patch radiator 12. Such addition of surface area may be desirable in some applications, if the surface area provided in the primary plane for the single element patch radiator 12 is limited.

Figure 4:
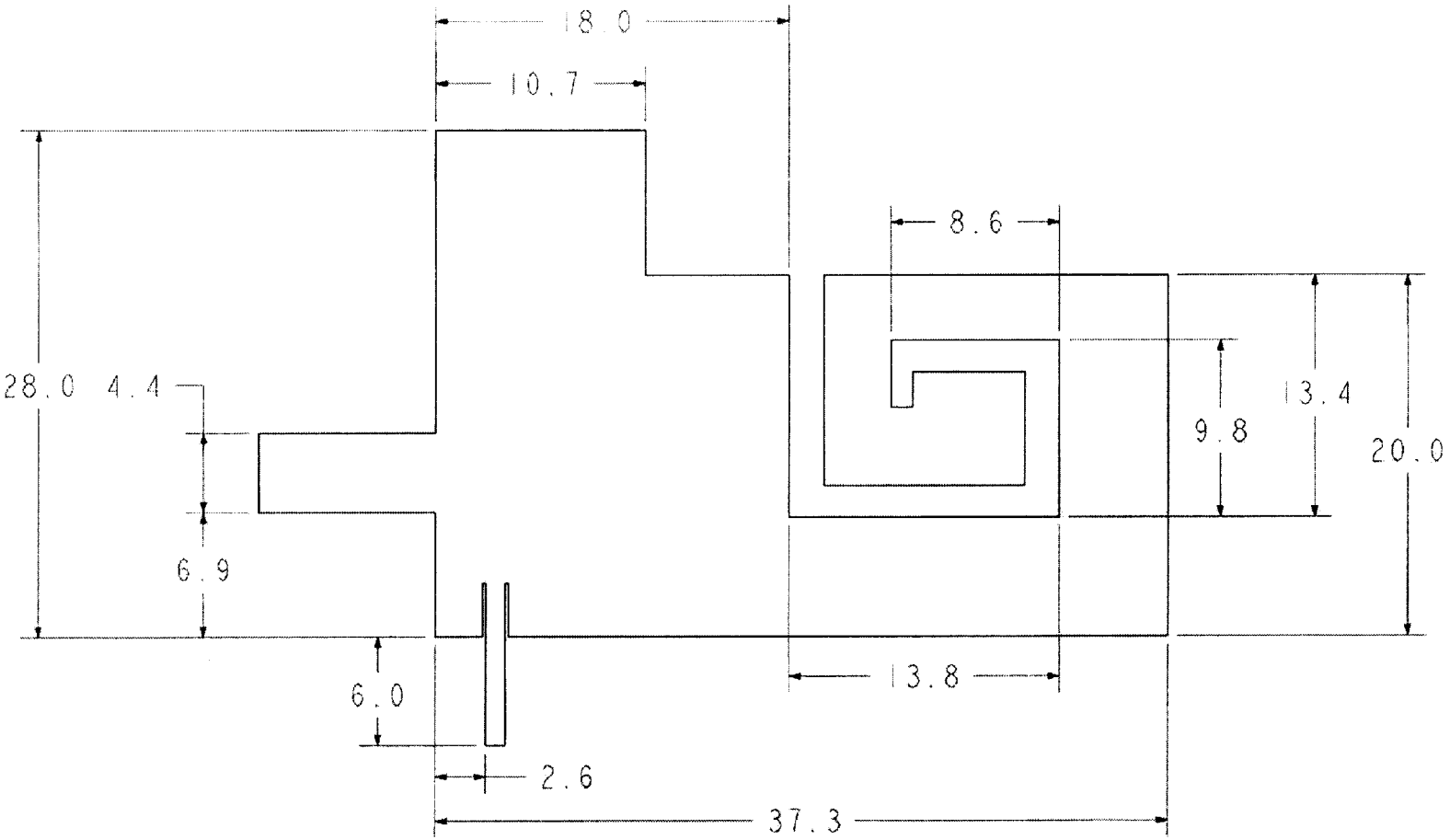
FIG. 4 illustrates radiator dimensions for a particular preferred embodiment of the invention of the type illustrated in FIGS. 1–4.

A particular embodiment antenna of the type shown in FIGS. 1–3 has been modeled using a finite element frequency domain analysis and prototypes have been tested. Modeling indicates frequency dependent nulls. Significant dimensions for an exemplary prototype embodiment are shown in FIG. 4. The dimensions are given in millimeters, and the antenna embodiment of FIG. 4 is intended to be an embodiment suitable for tri-band operation in the two European bands (GSM and DCS) and one U.S. band (PCS). According to the testing, the FIG. 4 embodiment meets typical return loss bandwidth for the three operating bands. The antenna is tuned, by adjusting the open loop positioning and sizing methods described above or by adjusting radiator size, separation between the radiator and ground plane(s), and/or feed/short locations. The spiral slot PIFA arrangement of the invention produces a high efficiency antenna. Impedance is large enough to make impedance mismatch losses small across the entire operating band of the antenna. Also, the entire antenna radiates even in the high band modes, leading to more gain. Typical measured peak gain performance in the low band (900 MHz) is 0 dBi and typical high band (1800 MHz) is 2.5 dBi.

While a specific embodiment of the present invention has been shown and others described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A multiband planar inverted-F antenna, the antenna comprising:

a first ground plane;

a dielectric support extending over at least a portion of said first ground plane while being separate therefrom;

a single element patch radiator on said dielectric support in an inverted-F relationship with said first ground plane, said single element patch radiator having an end shorted to said first ground plane;

a spiral slot in said single element patch radiator;

a feed to said single element patch radiator spaced apart from said end, said feed being located relative said spiral slot such that portions of the single element patch radiator enclosed by said spiral slot are fed as a series extension of another portion of said patch radiator.

2. The antenna of claim 1, wherein an opening in said spiral slot faces away from said feed.

3. The antenna of claim 1, wherein said spiral slot has an end that terminates at an edge of said single element patch radiator.

4. The antenna of claim 1, wherein said spiral slot is located distally from said end.

5. The antenna of claim 1, further comprising a second ground plane disposed between first ground plane and said single element patch radiator, said second ground plane being disposed electrically opposite only a portion of said single element patch radiator while said first ground plane is disposed electrically opposite an entirety of said single element patch radiator.

6. The antenna of claim 5, wherein each of said first and second ground planes extend beyond said single element patch radiator.

7. The antenna of claim 6, wherein said feed is located over said second ground plane.

8. The antenna of claim 1, wherein a distance between a center of said spiral slot and said feed point is set to control a desired high band resonance of the antenna.

9. The antenna of claim 1, wherein size of said spiral slot is set to control a desired low band resonance of the antenna.

10. A multiband planar inverted-F antenna, the antenna comprising:

a single element patch radiator, the patch radiator having a majority of its surface in a primary plane and its remaining surfaces defining, generally perpendicular from said primary plane, a feed extending from a first edge of said primary plane and a shorting post extending from a second edge of said primary plane;

a dielectric support generally matched in shape to said single element patch radiator;

a spiral slot in said single element patch radiator, said spiral slot terminating from a third edge of said primary plane, an opening in said spiral slot facing said third edge; and a first ground plane electrically opposite said majority of the surface of said single element patch radiator.

11. The antenna of claim 10, further comprising a second ground plane disposed electrically opposite only a portion of said majority of the surface of said single element patch radiator, said portion including said first edge and said feed.

12. The antenna of claim 11, wherein said first and second ground planes extend said beyond said single element patch radiator and are electrically connected at a point away from said single element patch radiator.

13. The antenna of claim 10, further comprising a tab extending from said third edge of said primary plane generally perpendicular to said primary plane and at a point separated from said spiral slot.

14. A multiband planar inverted-F antenna, the antenna comprising:

a first ground plane;

a dielectric support extending over at least a portion of said first ground plane while being separate therefrom;

a single element patch radiator on said dielectric support in an inverted-F relationship with said first ground plane, said single element patch radiator having an end shorted to said first ground plane;

a second ground plane disposed between first ground plane and said single element patch radiator, said second ground plane being disposed electrically opposite only a portion of said single element patch radiator while said first ground plane is disposed electrically opposite an entirety of said single element patch radiator;

a feed to said single element patch radiator spaced apart from said end, said portion of said single element patch radiator including said feed.

* * * * *